US005836697A

United States Patent [19]

Chiesa

[11] Patent Number: 5,836,697

[45] Date of Patent: Nov. 17, 1998

[54] OPENING DEVICE FOR FLEXIBLE CONTAINERS, CONTAINER PROVIDED WITH SUCH A DEVICE AND APPLICATION METHOD THEREOF

[75] Inventor: Emilio Tessera Chiesa, Leumann, Italy

[73] Assignee: Sales S.p.A., Turin, Italy

[21] Appl. No.: 737,063

[22] PCT Filed: May 3, 1995

[86] PCT No.: PCT/EP95/01665

§ 371 Date: Jan. 9, 1997

§ 102(e) Date: Jan. 9, 1997

[87] PCT Pub. No.: WO95/30601

PCT Pub. Date: Nov. 16, 1995

[30] Foreign Application Priority Data

May 5, 1994 [IT] Italy ..... T094A0361

[51] Int. Cl.[6] ..... B65D 33/00

[52] U.S. Cl. ..... 383/205; 383/66

[58] Field of Search ..... 383/66, 203, 204, 383/205, 206, 207, 208, 209; 229/87.05, 203, 238, 239

[56] References Cited

U.S. PATENT DOCUMENTS 3,266,965 8/1966 Spees .
4,328,924 5/1982 Neff et al. .
4,773,541 9/1988 Riddell .

FOREIGN PATENT DOCUMENTS 2172545 9/1986 United Kingdom .

*Primary Examiner*—Jes F. Pascua
*Attorney, Agent, or Firm*—Sughrue, Mion, Zinn, Macpeak & Seas, PLLC

[57] ABSTRACT

An opening device for sealed flexible containers (1), comprising a label (5) having an adhesive face (6) intended to be adhesively applied to the inner face of a wall (3) of the container (1) and incorporating a substantially central longitudinal strip (7) having an initial portion (10) constituted by a gripper tongue (10). The wall (3) of the container (1) is formed with an aperture, either a hole (4) or a partial cut (24) delimiting on the container wall (3) a tearing wing (25), so as to allow the gripper tongue (10) of the label (5) to be pulled outwardly thus performing tear breakage of the label (5) and the consequent tearing of the wall (3) of the container (1).

14 Claims, 6 Drawing Sheets

OPENING DEVICE FOR FLEXIBLE CONTAINERS, CONTAINER PROVIDED WITH SUCH A DEVICE AND APPLICATION METHOD THEREOF

TECHNICAL FIELD

The present invention is related to opening devices for flexible containers, particularly packets or envelopes for bulk food products (even under vacuum or overpressure), as well as for powders, liquids and other solid materials.

These containers, sealed by the manufacturers, are opened for removal of the contents traditionally by cutting or tearing a top portion thereof, and cannot be subsequently again closed adequately so as to prevent or at least limit accidental coming out of the products.

BACKGROUND ART

U.S. Pat. No. 3,266,965 discloses an opening device for containers of the above-referenced type formed by a pair of walls sealed around the respective peripheral edges, comprising a tape element intended to be applied to the inner face of one of said container walls and incorporating, along a substantially central area thereof, a longitudinal strip having a substantially initial portion defining a gripper tongue, and wherein said one container wall is formed with an aperture for enabling said gripper tongue to be pulled outwardly so as to perform tear separation of said longitudinal tear strip relative to said tape element and consequent tearing of said one container wall.

According to this known construction, which is specifically directed to containers at least in part made of thermoplastic sheet material, the tape element is a composite layered material having an inner core and two outer covering layers made of a thermoplastic material which is same as or compatible with the thermoplastic material of the container. This tape element is applied to the inner face of the container wall by means of heat and pressure, e.g. by heat welding.

The main drawback of this known solution resides in the complicated and thus expensive construction of the tape element, as well as in the limit that same can only be used in association with containers at least partially made of thermoplastic material.

On the other hand, the aperture of the container wall through which the gripper tongue is accessible from the outside is placed in the immediate proximity of one edge of the container wall and, consequently, the sealed region of the container walls is necessarily formed—so as to ensure airtight closure of the container before opening thereof—with an inwardly recessed region astride the tape element.

A further drawback of this known construction resides in the relatively difficult and thus expensive manufacturing of the container provided with the opening device, in connection with heat-pressure welded sealed connection both of the device onto the corresponding container wall, and between the two container walls.

Pull strip opening arrangements for containers are also generally known from U.S. Pat. No. 4,773,541 and U.S. Pat. No. 4,328,924 and from GB-A-2,172,545.

DISCLOSURE OF THE INVENTION

The object of the present invention is to overcome the above drawbacks and to provide a simple and cheap opening device, which is adapted to be applied to containers made of any kind of material, i.e. not necessarily of thermoplastic material, and which enables both to open the first time the container in a convenient and practical way, and to provide immediate visual indication of any prior opening of the container.

A further object of the invention is to provide an opening device which is adapted to be applied onto the container in a simple and mechanized way.

Another object of the invention is to provide an opening device without any limitations in connection with the material both of the device itself and of the container to which the device is intended to be associated, and also not requiring heat welding techniques for the application thereof.

Still a further object of the invention is to ensure, in the applied condition of the opening device, a total hermetic seal of the container so as to preserve any underpressure or overpressure formed therein.

The device according to the invention is primarily characterized in that said tape element is a label having an adhesive face adhesively secured to said inner face of said one container wall, and in that said aperture for the gripper tongue of the longitudinal tear strip of the label is formed in an inner area of said one wall with respect to said sealed peripheral edges of the container walls.

In the following specification and claims the term "longitudinal strip" of the label is to be intended as referred both to a small web or string which is distinct from the label and is applied over one face thereof, or even to an integral portion of the label defined between two parallel series of adjacent pre-cut segments.

The label has conveniently an elongated shape and preferably the longitudinal strip is extending substantially along the entire length of the label. The longitudinal strip may be applied either on one or on the other face of the label, but preferably on the face opposite to the adhesive one, i.e. on the face which is not in contact with the container wall. In this case, the gripper tongue may be conveniently defined by a cut of the label formed astride of the longitudinal strip. This cut is substantially U-shaped, and is conveniently placed at a predetermined distance from one end of the label.

According to a first embodiment of the invention, said aperture of the container wall is formed by a complete hole through which the gripper tongue is fitted and projects outwardly, in an accessible way from outside the container.

According to another embodiment of the invention, which is presently to be considered as the preferred one, the aperture of the container wall is constituted by a partial cut which is separated, through a non-pierced area of the container wall, from said cut delimiting the gripper tongue of the label.

In this case the partial cut, which is also placed astride of the longitudinal strip of the label, defines on the container wall a tear wing against which the gripper tongue of the label adheres. In this embodiment, when the tear wing is pulled outwardly, breakage of said unimpaired area of the container wall is accomplished and, consequently, entrainment of the gripper tongue occurs thus producing tear breakage of the label and consequent tearing of the container wall.

This solution is adapted to ensure, in the applied condition of the opening device, a perfect hermetic seal of the container, since any communication between the interior thereof and the outer environment is excluded. In the case of the first embodiment, wherein the aperture of the container wall is constituted by a complete hole, to the aim of ensuring hermetic seal of the container the invention contemplates an air-tight wall applied in correspondence of the U-shaped cut of the label and having a central area which is made non-adhesive and is arranged in correspondence of the gripper tongue of the longitudinal strip.

The longitudinal strip may also be applied only onto a portion of the label, in the area which is intended to define the tearing line. The portions of the label comprised between the two ends thereof thus act as reinforcement elements of the container wall, so as to efficiently prevent undesired breakage or tearing thereof beyond the predetermined limits.

In case the longitudinal strip is applied between the container wall and the wall of the label, the previous U-shaped cut may be simplified as a cut over the strip without cutting also the label wall. Air-tightness of the package shall be ensured in this case by the integrity without any cuts of the label wall and, therefore, application of an air-tight wall is no more necessary. Opening of the label wall simultaneously with tearing of the container wall may be pre-arranged by means of a pre-cut line or through a pre-punching of an area of the label which shall be removed by pulling the gripper tongue.

According to a further aspect of the invention, the opening device also comprises an adhesive portion which is associated laterally and parallelly to the longitudinal strip of the label and is intended to be positioned on the outer surface of said container wall following the first opening thereof.

This adhesive wall, the function of which is to enable reclosing of the container by simply folding the end edge thereof against said outer surface, may be formed by an area of the adhesive face itself of the label, or by an additional bi-adhesive label or by a simple piece of adhesive tape.

The invention is also related to a container provided with an opening and reclosing device such as set forth in the above, as well as to a method for application of the device itself.

BRIEF DESCRIPTION OF THE DRAWINGS

The invention will now be disclosed in detail with reference to the accompanying drawings, purely provided by way of non-limiting example, in which.

PREFERRED EMBODIMENTS OF THE INVENTION

Figure 1:
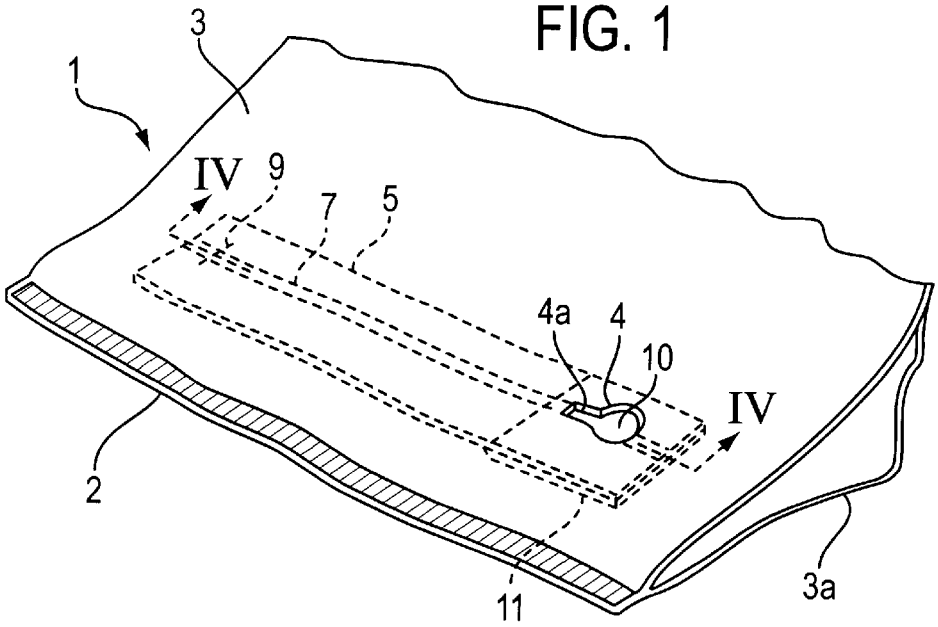
FIG. 1 is a diagrammatic and partial perspective view of a flexible container provided with an opening device according to a first embodiment of the invention.

Referring initially to FIGS. 1 through 5, reference numeral 1 generally designates a flexible container, for instance constituted by a sealed packet normally made of paper, thermoplastic material, plasticized paper or any other suitable material, which is intended to contain bulk food products, even under vacuum or overpressure.

The container 1 is formed by two walls 3, 3a sealingly connected to each other laterally and along one end 2 of the container 1, by means of heat welding or glueing.

The wall 3 is formed with a hole 4, normally having a circular shape, situated in correspondence of a lateral area at a certain distance from the end 2 and closer to one side edge of the container 1 than to the other side edge. A breakage-guiding slot 4a departing from the hole 4 may be provided.

A label 5 having an elongated rectangular shape and provided with an adhesive, preferably self-adhesive face 6, is applied onto the inner face of the wall 3, at the same level of the hole 4.

The label 5 is preferably made of paper or thermoplastic material and the like.

Figure 2:
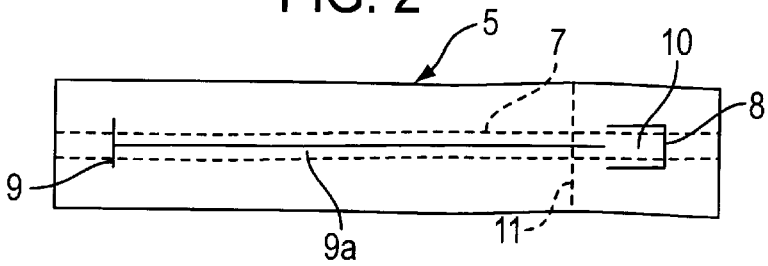
FIG. 2 is a plan view showing the adhesive label employed in the opening device of FIG. 1.

As it can be better seen in FIG. 2, the label 5 incorporates along a substantially central area thereof a longitudinal strip 7 which, in the case of the shown embodiment, is constituted by a narrow web, for instance made of plastic material, which is adherent to the outer face of the label, i.e. the face which is not in contact with the wall 3 of the container 1. As an alternative, the strip 7 may be constituted by a string or wire applied over the inner face of the label, or by a portion of the label 5 itself delimited between two series of adjacent pre-punched segments directly formed across the label.

In the embodiment shown in FIG. 2, the strip 7 is extending over the entire length of the label 5. Reference numeral 8 designates a U-shaped cut formed astride of the strip 7 at a predetermined distance from one end of the label 5. The cut 8 is made across both the label 5 and the strip 7. In correspondence of the other end of the label 5 a second cut 9 is formed through the wall of the label 5 and the strip 7. A longitudinal pre-cut or pre-punched line 9*a* (FIG. 2) may possibly be formed in the wall of the label 5, spanning between the cuts 8 and 9 to the aim of facilitating breakage of the wall of the label 5 along the strip 7.

Figure 4:
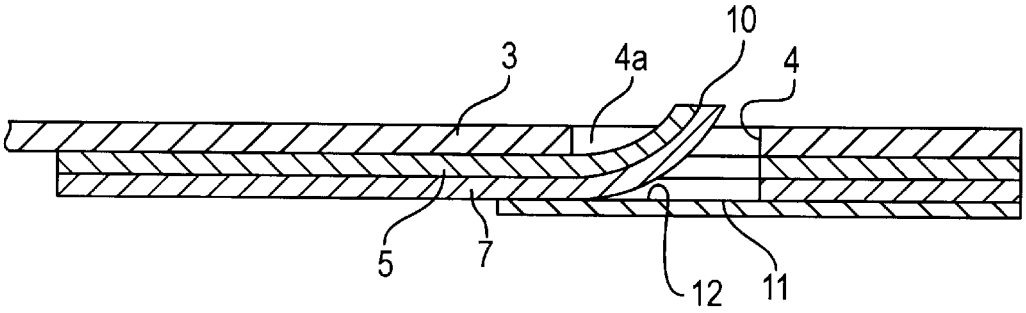
FIG. 4 is a diagrammatic longitudinal section taken along line IV—IV of FIG. 1.

The end of the strip 7 corresponding to the cut 8 is bent outwardly and is arranged through the hole 4 of the wall 3, so as to define a gripper tongue 10 projecting outside of the container 1 (FIG. 4).

Figure 3:
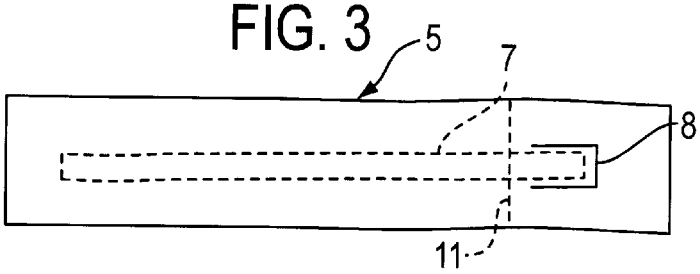
FIG. 3 shows an alternative embodiment of FIG. 2.

In the alternative embodiment shown in FIG. 3, the longitudinal strip 7 is applied only onto a portion of the label 5, in correspondence of the area which is intended to define the tearing line. In this case, the cut 8 is only affecting the wall of the label 5 and it is not necessary to provide the second cut 9. Even in this case a longitudinal pre-cut line may be contemplated.

Figure 5:
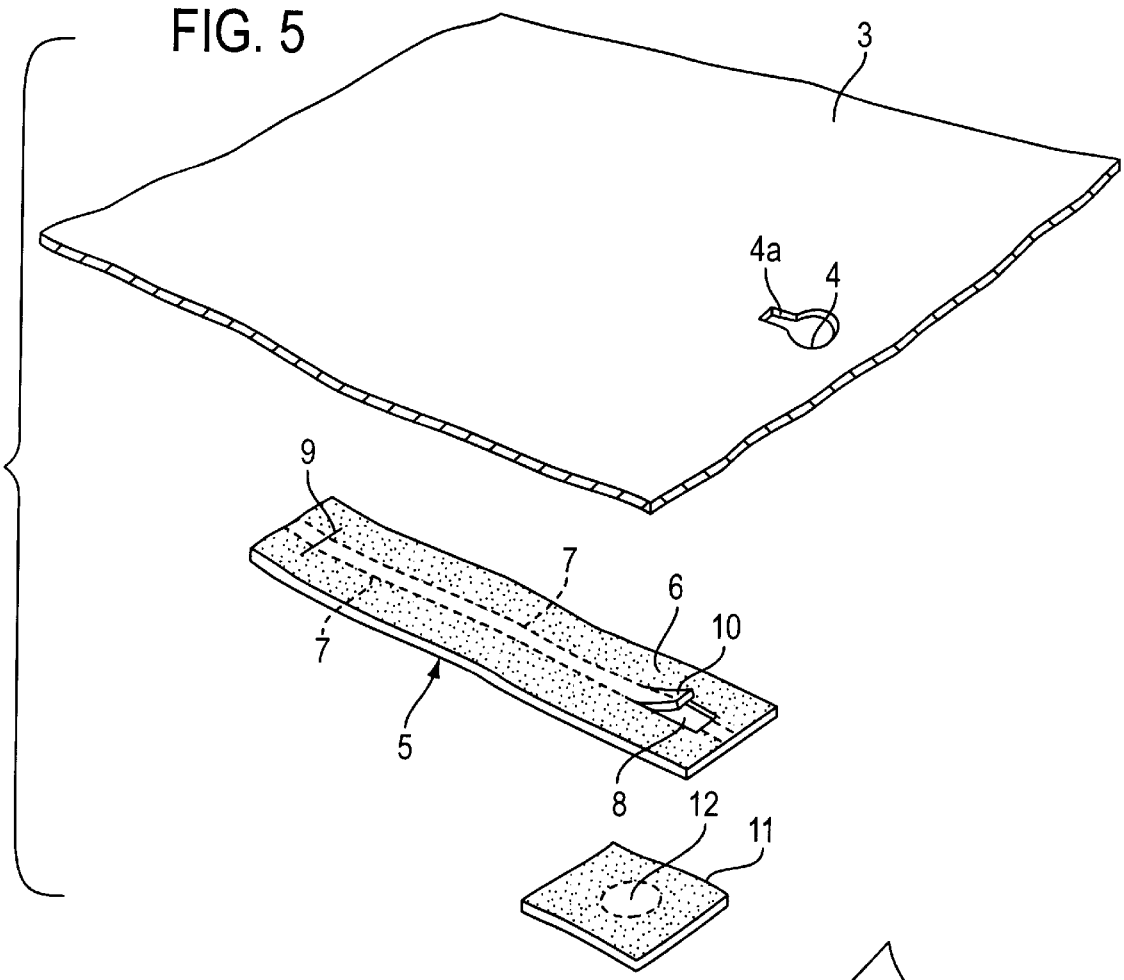
FIG. 5 is a perspective exploded view of the device of FIG. 1.

Referring to FIGS. 4 and 5, reference numeral 11 indicates an adhesive air-tight wall, defined by a second label whose length is appreciable shorter than that of the label 5, and which is applied onto one face thereof in the area corresponding to the hole 4. The air-tight wall 11 has an area 12 which is made non-adhesive and is arranged in correspondence of the cut 8, i.e. of the gripper tongue 10.

The air-tight wall 11 may possibly be applied outside, over the hole 4 and the gripper tongue 10.

Figure 7:
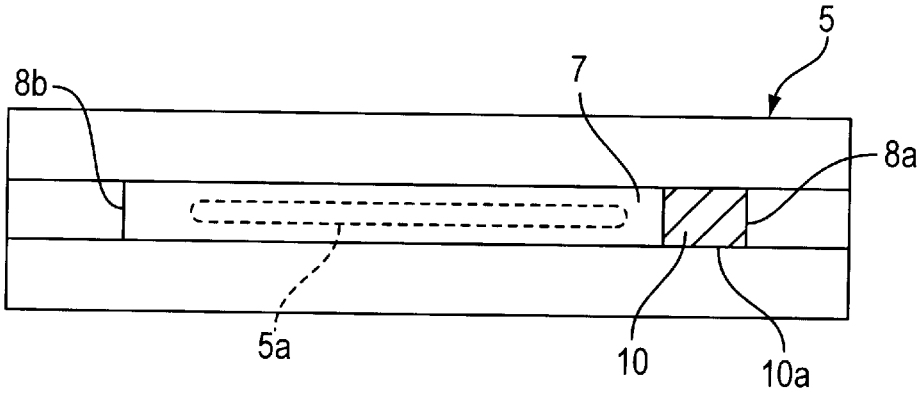
FIG. 7 shows a further alternative embodiment of FIG. 2.
Figure 8:
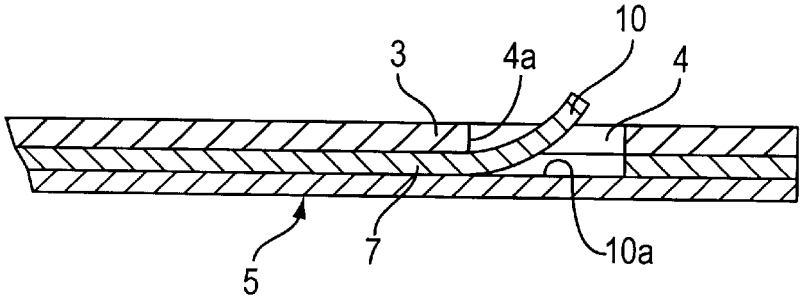
FIG. 8 is a diagrammatic section similar to FIG. 4 according to the alternative embodiment of FIG. 7.

FIGS. 7 and 8 depict a second embodiment of the label which may be employed in the device according to the invention. In this second embodiment the strip 7 is applied on the adhesive face 6 of the label 5 and in use it is arranged between the wall 3 of the container 1 and the label 5. In this case two cuts 8*a*, 8*b* may be provided, only affecting the wall of the strip 7 without piercing the label wall. Air-tight seal of the packet shall be ensured by the integrity of the wall of the label 5 across which no cuts are provided. In this case application of an air-tight wall is thus unnecessary. In the area of the cut 8*a*, the wall 5 is provided with a portion 10*a* which is made non-adhesive and in correspondence of which the strip 7 is detached from the label 5 and directly forms the gripper tongue 10.

Opening of the wall of the label 5 simultaneously to tearing of the wall 3 of the container 1 may also be obtained by virtue of a pre-cut or pre-punching line of an area 5*a* of the label 5 which shall be removed when pulling the gripper tongue 10.

Normally the container 1 is formed starting from a continuous sheet, wound on a reel, which is then severed according to the desired size, folded and heat welded along the lateral edges, then filled with the products and lastly sealed along the end 2.

Application of the opening device according to the invention is performed on the continuous sheet forming the holes 4 at predetermined distances and any punchings for possibly delimiting areas to be tear-removed, and then positioning and adhering the respective labels 5 such as previously disclosed. In case of tear-web 7 is arranged outside of the label, the second labels 11 will then be applied, according to what has been previously clarified.

Following filling in, the container 1 is then sealed by means of heat welding or equivalent systems along the end 2 thereof.

Figure 6:
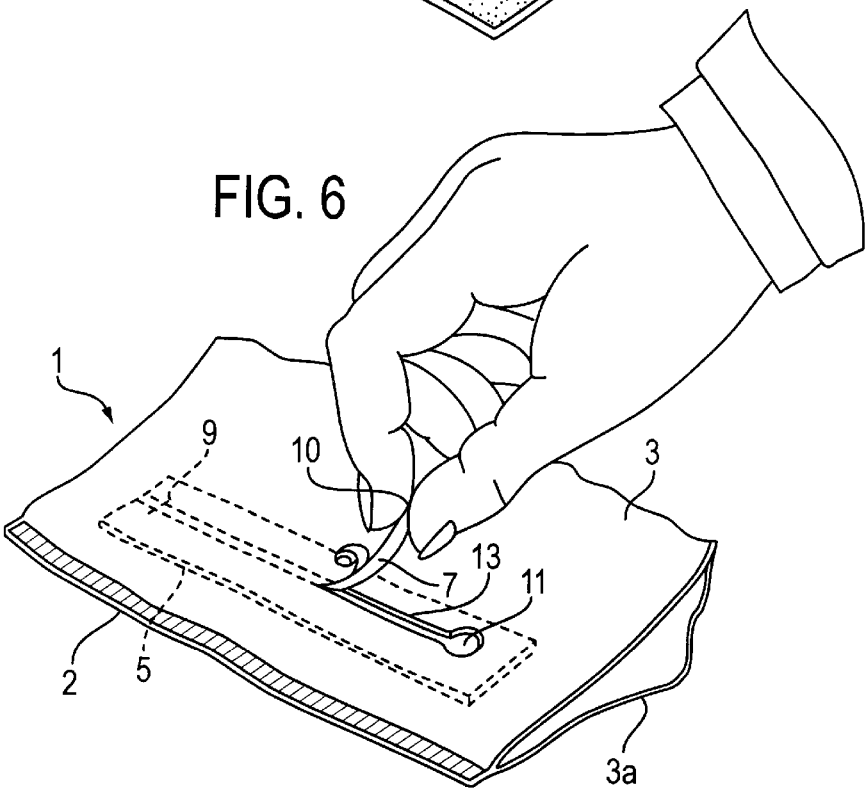
FIG. 6 is a perspective view depicting the container during opening thereof.

To perform opening of the container 1, it is sufficient to grasp the gripper tongue 10 which projects across the hole 4 and pull this tongue outwardly, which causes tear-separation of the strip 7 from the label 5 and, consequently, tearing of the wall 3 such as depicted in FIG. 6, simultaneously with tearing of the label 5 such as previously disclosed. In this way an opening 13 is generated along the wall 3, extending from the gripper tongue 10 of the strip 7 as far as the second cut 9, if present, thereof, or as far as its opposite end, whereby the strip 7 is completely separated from the label 5.

The opening 13 enables convenient withdrawal of the contents from the packet, and the lateral and longitudinal end portions of the label 5 which remain adherent to the inner surface of the wall 3 effectively prevent breakage thereof beyond the limits of the initial tearing.

The invention contemplates four alternative embodiments of the device intended to permit subsequent reclosing of the container 1 by folding the end 2 thereof above the opening 13, so as to prevent accidental outlet therefrom of the contents.

Figure 9:
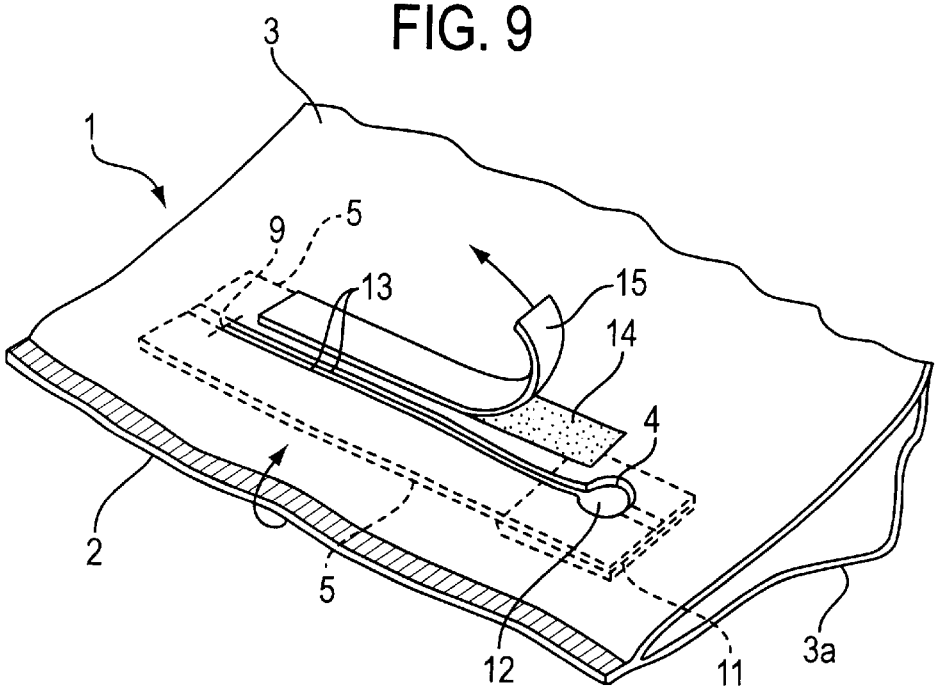
FIG. 9 depicts the container of FIG. 1 provided with a reclosing device.

The first variant, shown in FIG. 9, is employing a supplementary bi-adhesive label 14 having one face applied outside of the wall 3, laterally of the strip 7 of the label 5, and on the opposite face of which a peelable protection 15 is applied. Following opening of the container 1, such as previously disclosed, the protection 15 is removed and the end 2 can than be folded and adhered through the auxiliary label 14 against the wall 3, beyond the opening 13.

Figure 10:
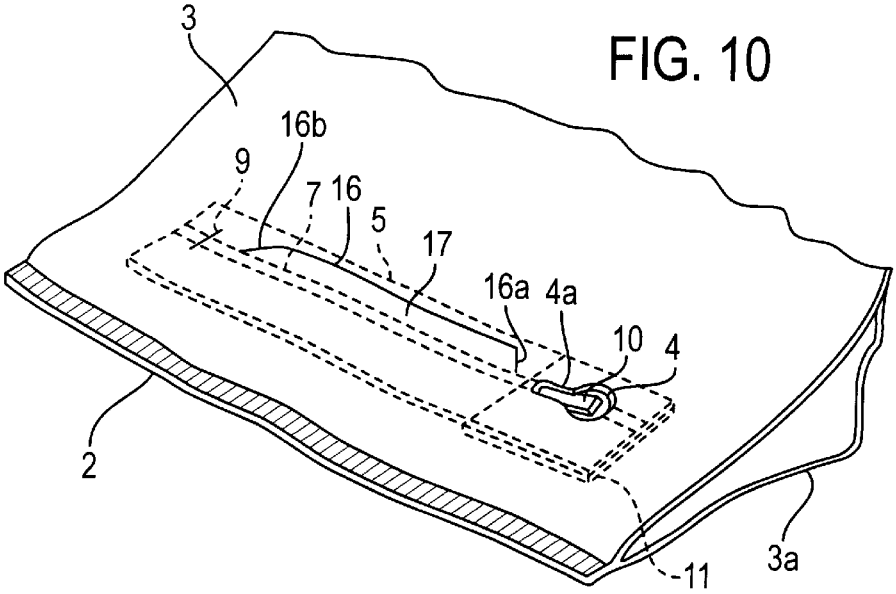
FIG. 10 shows a first alternative embodiment of the reclosing device.
Figure 11:
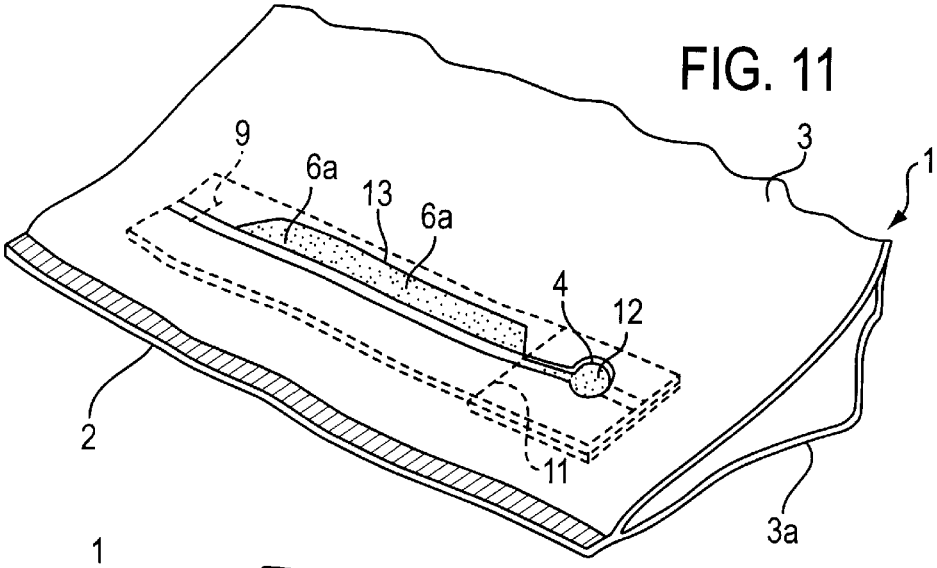
FIG. 11 shows the opened condition of the device according to FIG. 10.
Figure 12:
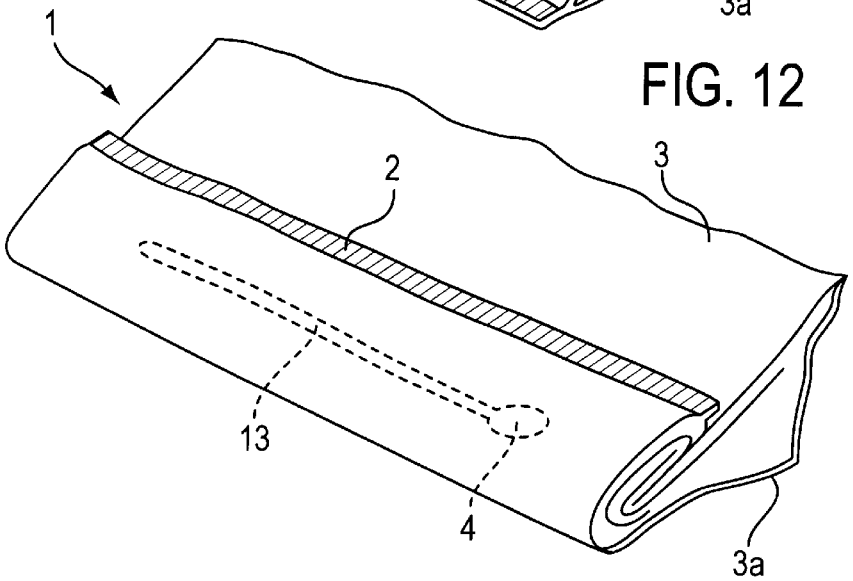
FIG. 12 shows the condition of reclosure of the container with the device according to FIGS. 10 and 11, FIGS. 13 and 14 show two further respective alternative embodiments of the reclosing device.

The second variant, depicted in FIGS. 10, 11 and 12, contemplates the formation on the wall 3 of a pre-cut 16 punched in the area of application of the label 5, i.e. above the latter, laterally and parallelly to the strip 7. The pre-cut 16 actually is bordering on the area of the wall 3 along which the strip 16 extends, and has an initial section 16*a* and a final section 16*b* which are respectively diverging and converging with respect to that area, so as to define a means for facilitating removal.

The cut 16 in practical terms is delimiting a wing 17 which, upon tearing of the strip 7 of the label 5, i.e. upon formation of the aperture 13, is removed together with the strip 16 thus exposing a corresponding portion 6*a* of the adhesive face 6 of the label 5 (FIG. 11). The portion 6*a* can then be used for reclosing the container 1, by adhering thereagainst the wall 3 beyond the opening 13, after folding the end 2 of the container 1 over such opening in the way shown in FIG. 12.

Figure 13:
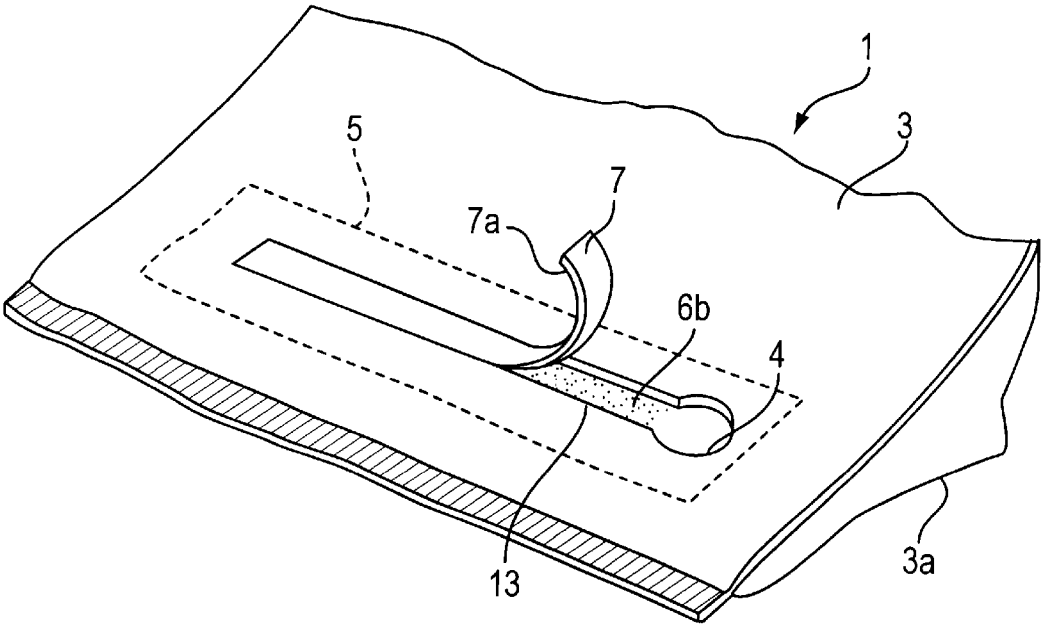

The third variant, depicted in FIG. 13, can be applied in the embodiment according to FIGS. 7 and 8, i.e. in case the strip 7 is arranged between the wall 3 of the container and the label 5. This variant provides the use of a strip 7 having a substantial width which, upon removal thereof and trailing therewith a corresponding portion 7*a* of the wall of the container 1, exposes an adhesive portion 6*b* of the label 5.

Figure 14:
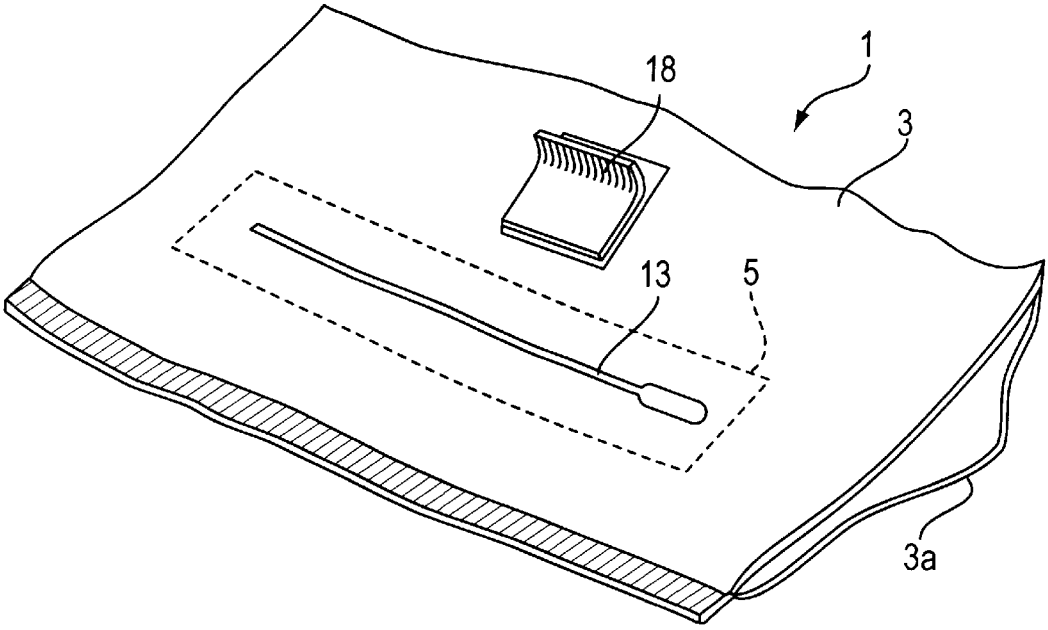

The fourth variant shown in FIG. 14 contemplates the use of a simple adhesive tape 18 which is applied on the container wall and is provided with a releasable protection member.

It is evident that the method for applying the device to the continuous sheet employed for the subsequent formation of the container 1 shall contemplate in the case of the first variant the application of the auxiliary labels 14, and in the case of the second embodiment the formation of the cuts 16.

In the case of the third variant it will be necessary to employ strips 7 having a greater width, and in the case of the fourth variant it will be necessary to provide application of the adhesive tape 18 onto the container wall.

Figure 15:
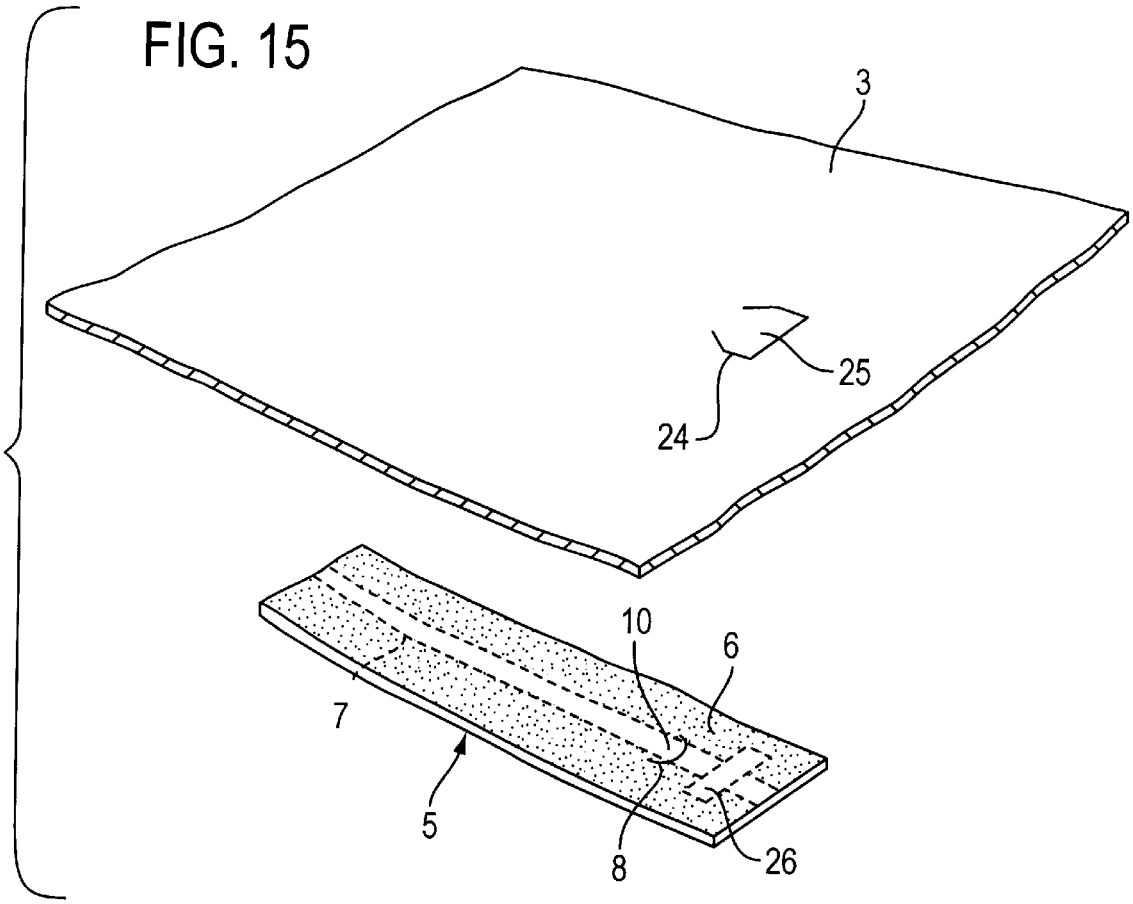
FIG. 15 is an exploded perspective view, similar to FIG. 5, showing a further embodiment of the device according to the invention, which is presently to be considered as the preferred embodiment thereof.
Figure 16:
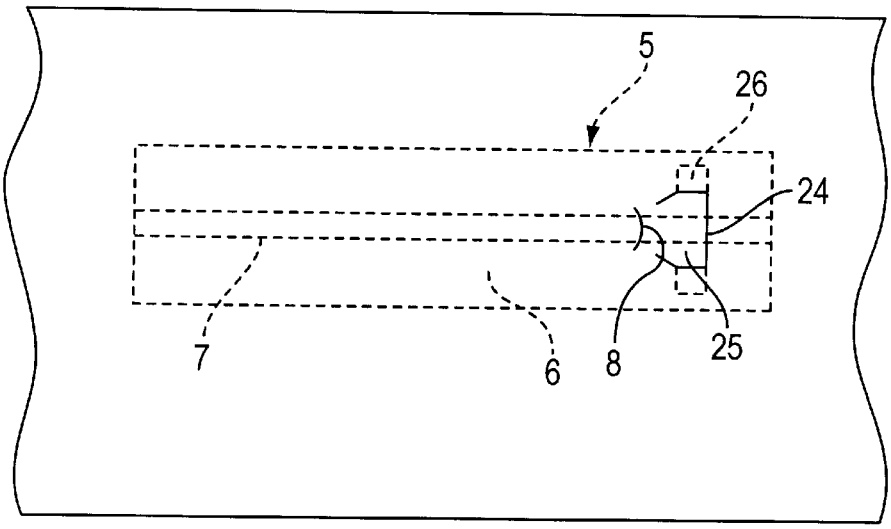
FIG. 16 is a diagrammatic top plan view of the device according to FIG. 15.

FIGS. 15 and 16 diagrammatically show a further alternative embodiment of the opening device according to the invention, which is presently considered as the preferred embodiment.

This variant differs from the previously disclosed embodiment essentially in that the complete hole 4 on the wall 3 of the container 1 is replaced by a partial cut of this wall 3, having for instance the shape depicted at 24 in FIGS. 15 and 16. The partial cut 24 is formed astride of the longitudinal strip 7 of the label 5 and delimits on the wall 3 a tear wing 25. As it can be better seen in FIG. 16, the partial cut 24 is arranged in such a way that the tear wing 25 is separated from the cut 8 defining the gripper tongue 10 of the label 5, through unpierced areas of the wall 3. The partial cut 24 is conveniently formed so as to be provided with end sections converging towards the cut 8 (such as shown in the figures), or even so as to be placed astride thereof. In any case it is necessary that no communication exists between the cut 8 and the partial cut 24.

Reference 26 designates a portion made non adhesive of the adhesive face 6 of the label 5, across the central area thereof corresponding to the strip 7, and placed in correspondence at least of an initial portion of the tear wing 25, so as to allow convenient grasp thereof from outside of the container 3.

Even in this case the container 1 is formed starting from a continuous sheet, wound on a reel, which is then size-cut, folded and heat welded along its sides, then filled in with the products and lastly sealed as in the case of the embodiments disclosed in the above.

Application of the opening device on the continuous sheet is performed in this case punching the partial cuts 24 at predetermined distances, and then positioning and adhering the respective labels 5 with the corresponding cuts 8 and the corresponding non-adhesive portion 26 arranged in the way previously explained.

Following filling in and sealing of the container 1, the absence of any communication to the exterior through the opening device ensures a total hermetic seal.

In order to open the container 1 it is sufficient in this case to grasp the tear wing 25 in correspondence of the non-adhesive portion 26 of the label 5, and pull this tear wing 25 outwardly, thus causing breakage of the areas of the wall 3 comprised between the partial cut 24 and the cut 8 and, consequently, "capture" of the gripper tongue 10 and consequent tear removal of the strip 7, thus performing tearing of the wall 3, correspondingly to what is shown in FIG. 6 with reference to the first embodiment.

The various embodiments of the reclosing device of the container 1, previously disclosed with reference to FIGS. 9 through 14, can also be employed in the embodiment of FIGS. 15 and 16.

Naturally the details of construction and the embodiments of the device may be widely varied with respect to what has been disclosed and illustrated, without thereby departing from the scope of the present invention such as defined in the appended claims.

I claim:

1. An opening device for flexible sealed containers formed by a pair of walls sealed around respective peripheral edges, said opening device comprising a tape element adapted to be applied to the inner face of one of said container walls and incorporating along a substantially central area thereof, a longitudinal strip having a substantially initial portion defining a gripper tongue, wherein said gripper tongue is adapted to be pulled outwardly through an aperture in said one container wall so as to perform tear separation of said tape element by said longitudinal tear strip and to tear said one container wall, wherein said tape element is a label having an adhesive face adapted to be adhesively secured to said inner face of said one container wall and said gripper tongue of said longitudinal tear strip of said label is adapted to be located in an inner area of said one wall with respect to said sealed peripheral edges of the container walls, wherein the gripper tongue of the label is defined by a cut of the label, wherein the gripper tongue of the label is adapted to adhere to a tear wing of said wall of the container, which tear wing is delimited by a partial cut adapted to be separated, through non-pierced areas of said wall of the container, from said cut delimiting the gripper tongue of the label, wherein said longitudinal strip of the label is adapted to extend across said partial cut and wherein the adhesive face of the label has a non-adhesive portion adapted to be arranged in correspondence with at least one initial portion of the tear wing of said wall of the container.

2. A device according to claim 1 wherein the label has an elongated shape and said longitudinal strip extends substantially along the entire length of the label and wherein said gripper tongue is defined by a substantially U-shaped cut formed astride of said strip at a predetermined distance from one end of the label.

3. A device according to claim 1 wherein the label has an elongated shape and said longitudinal strip extends along a length which is shorter than the length of the label and wherein the gripper tongue is defined by a U-shaped cut formed in the wall of the label adjacent to one end of the strip.

4. A device according to claim 1 wherein said strip is applied on the face of the label opposite to said adhesive face.

5. A device according to claim 1 wherein said strip is applied on the adhesive face of the label and wherein said gripper tongue is defined in correspondence with a non-adhesive portion of the adhesive face of the label.

6. A device according to claim 1 wherein the label has a second cut opposite to said first mention cut and formed astride of the longitudinal strip at a predetermined distance from the other end of the label.

7. A device according to claim 1 further comprising an adhesive member laterally associated with said longitudinal strip of the label and adapted to be positioned on the outer surface of the said wall of the container.

8. A device according to claim 7 wherein said adhesive member is an area of the adhesive face of the label.

9. A device according to claim 7 wherein said adhesive member is defined by an auxiliary bi-adhesive label.

10. An opening device for flexible sealed containers formed by a pair of walls sealed around the respective peripheral edges, said opening device comprising a tape element adapted to be applied to the inner face of one of said container walls and incorporating, along a substantially central area thereof, a longitudinal strip having a substantially initial portion defining a gripper tongue, wherein said gripper tongue is adapted to be pulled outwardly through an aperture in said one container wall so as to perform tear separation of said tape element by said longitudinal tear strip and to tear said one container wall, wherein said tape element is a label having an adhesive face adapted to be adhesively secured to said inner face of said one container wall and said gripper tongue of said longitudinal tear strip of said label is adapted to be located in an inner area of said one wall with respect to said sealed peripheral edges of the container walls, wherein the gripper tongue of the label is defined by a cut of the label and further comprising an adhesive air-tight wall defined by a second label applied in correspondence with the cut of said label, said second label having a non-adhesive central area placed in correspondence with the gripper tongue of the longitudinal strip.

11. A device according to claim 11 wherein the second label is applied on the face of said label opposite to the respective adhesive face.

12. A sealed flexible container formed by a pair of walls sealed around the respective peripheral edges, said container having an opening device comprising a tape element applied to an inner face of one of said container walls and incorporating, along a substantially central area thereof, a longitudinal strip having a substantially initial portion defining a gripper tongue, wherein said one container wall is formed with an aperture for enabling said gripper tongue to be pulled outwardly so as to perform tear separation of said tape element by said longitudinal tear strip and to tear said one container wall, wherein said tape element is a label having an adhesive face adhesively secured to said inner face of said one container wall and said aperture is formed in an inner area of said one wall spaced from said sealed peripheral edges of the container walls, wherein the gripper tongue 10 of the label is defined by a cut of the label, wherein the gripper tongue of the label adheres to a tear wing of said wall of the container, which tear wing is delimited by a partial cut separated from said first mention cut delimiting the gripper tongue of the label, wherein said partial cut is arranged astride of the longitudinal strip of the label and wherein the adhesive face of the label has a nonadhesive portion adapted to be arranged in correspondence with at least one initial portion of the tear wing of said wall of the container.

13. A sealed flexible container formed by a pair of walls sealed around the respective peripheral edges, said container having an opening device comprising a tape element applied to the inner face of one of said container walls and incorporating, along a substantially central area thereof, a longitudinal strip having a substantially initial portion defining a gripper tongue, wherein said one container wall is formed with an aperture for enabling said gripper tongue to be pulled outwardly so as to perform tear separation of said tape element by said longitudinal tear strip and to tear said one container wall, wherein said tape element is a label having an adhesive face adhesively secured to said inner face of said one container wall and said the gripper tongue of said longitudinal tear strip being formed in an inner area of said one wall in spaced relation to said sealed peripheral edges of the container walls, wherein the gripper tongue of the label is defined by a cut of the label and further comprising an adhesive air-tight wall defined by a second label applied in correspondence of the cut of said label, said second label having a nonadhesive central portion place in correspondence with the gripper tongue of the longitudinal strip.

14. A sealed flexible container as set forth in claim 13 wherein the second label is applied on the face of said label opposite to the respective adhesive face.

* * * * *